US009247330B2

(12) United States Patent
Lee

(10) Patent No.: US 9,247,330 B2
(45) Date of Patent: Jan. 26, 2016

(54) SPEAKER MODULE

(71) Applicant: Chi Mei Communication Systems, Inc., New Taipei (TW)

(72) Inventor: Hsiao-Yuan Lee, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 0 days.

(21) Appl. No.: 13/928,511

(22) Filed: Jun. 27, 2013

(65) Prior Publication Data

US 2014/0169613 A1 Jun. 19, 2014

(30) Foreign Application Priority Data

Dec. 13, 2012 (TW) ..... 101224118 U

(51) Int. Cl.

| | |
|---|---|
| ***H04R 1/02*** | (2006.01) |
| *H04R 1/06* | (2006.01) |
| *H01R 12/70* | (2011.01) |
| *H01R 12/71* | (2011.01) |

(52) U.S. Cl.

CPC ..... *H04R 1/025* (2013.01); *H01R 12/7076* (2013.01); *H01R 12/714* (2013.01); *H04R 1/06* (2013.01)

(58) Field of Classification Search

CPC ..... H04R 1/06; H04R 9/045; H04R 2499/11; H04R 12/714; H01R 12/57; H01R 12/7076; H01R 12/714

USPC ..... 381/386, 395, 409

See application file for complete search history.

(56) References Cited

U.S. PATENT DOCUMENTS

| | | | | |
|---|---|---|---|---|
| 4,138,656 | A * | 2/1979 | Resnicow | H01C 1/44 338/322 |
| 6,763,120 | B2 * | 7/2004 | Sugiyama | H04R 1/06 381/395 |
| 7,362,877 | B2 * | 4/2008 | Honda | H04M 1/03 381/409 |
| 7,715,585 | B2 * | 5/2010 | Nagata | H04R 9/025 381/394 |
| 8,009,855 | B2 * | 8/2011 | Chiba | H01R 13/2442 381/396 |
| 8,023,685 | B2 * | 9/2011 | Honda | H04R 9/00 381/394 |
| 8,155,374 | B2 * | 4/2012 | Yuasa | H04R 1/06 381/400 |
| 2002/0176596 | A1 * | 11/2002 | Fujinami et al. | 381/409 |
| 2012/0114163 | A1 * | 5/2012 | Yang | H01Q 1/44 381/386 |
| 2013/0279734 | A1 * | 10/2013 | Klein | H04R 1/02 381/395 |

FOREIGN PATENT DOCUMENTS

JP 2008219065 A * 9/2008

* cited by examiner

*Primary Examiner* — Curtis Kuntz
*Assistant Examiner* — Ryan Robinson
(74) *Attorney, Agent, or Firm* — Novak Druce Connolly Bove + Quigg LLP

(57) ABSTRACT

A speaker module includes a speaker, a bracket and a pair of conductive pins. The bracket holds the speaker. The pair of pins is arranged diagonally on the corners of the bracket and is configured for mounting to and electrically connecting the speaker with a PCB.

20 Claims, 5 Drawing Sheets

SPEAKER MODULE

BACKGROUND

1. Technical Field

The present disclosure relates to a speaker module, and particularly relates to a speaker module used in an electronic device.

2. Description of Related Art

Electronic devices, such as a mobile phone, include a speaker module for playing sound. The speaker shape, which may be rectangular or oval, always have pins arranged symmetrically on a same side of the speaker module, such as from left to right or from up to down. The space for mounting speaker module inside the electronic device is very limited, thereby the speaker module is compact and the distance between pins is close. The pins are configured to be soldered to pads set on a printed circuit board (PCB) of the electronic device. Since the distances between the pads and the pins are close, dislocation and misalignments between pins and pads are common. Thus, errors in assembling the speaker module easily occur and the performance and the reliability of the speaker module may be adversely affected.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean "at least one".

Figure 1:
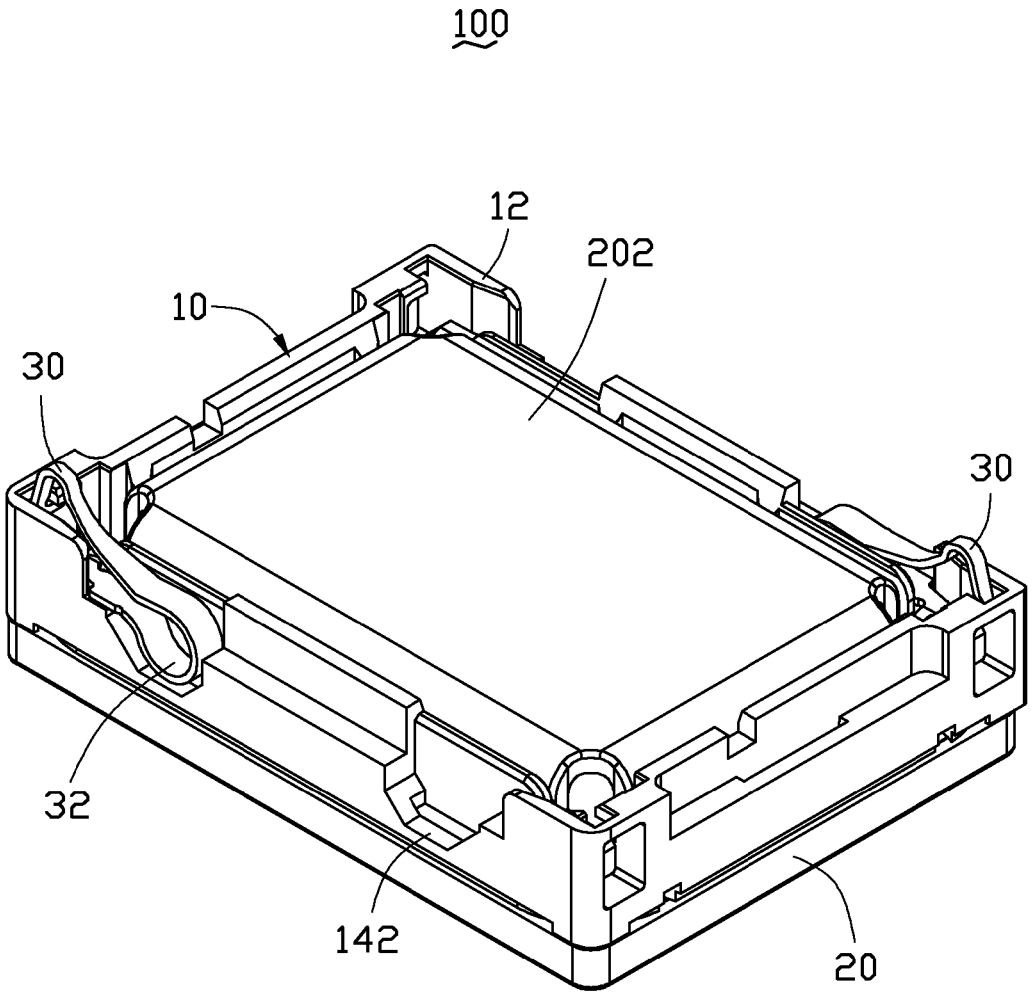
FIG. 1 illustrates a view of a speaker of an exemplary embodiment of the present disclosure.

FIG. 1 shows a speaker module 100 of an exemplary embodiment of the present disclosure. The speaker module 100 is used for portable electronic devices, such as mobile phones, personal digital assistants, and tablet computers, for playing sound.

Figure 2:
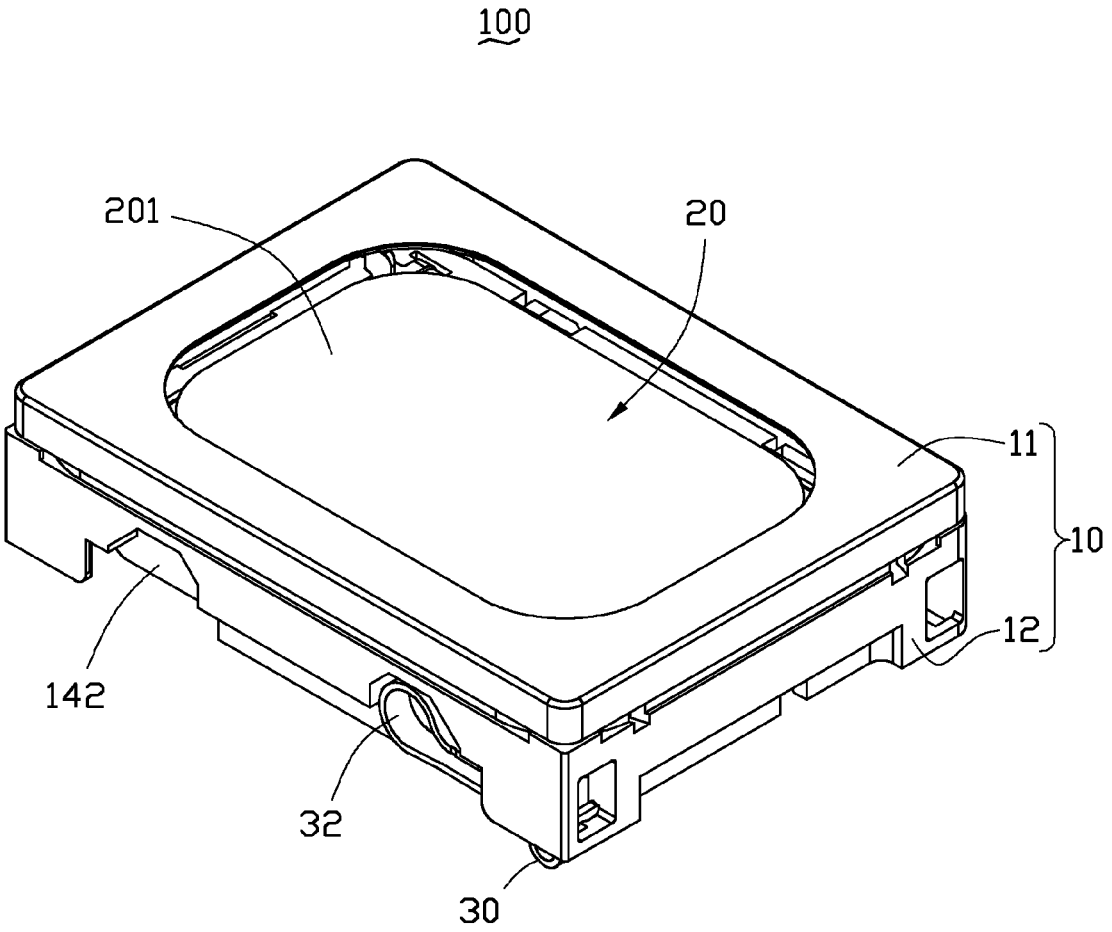
FIG. 2 illustrates the speaker of FIG. 1 in another view.
Figure 4:
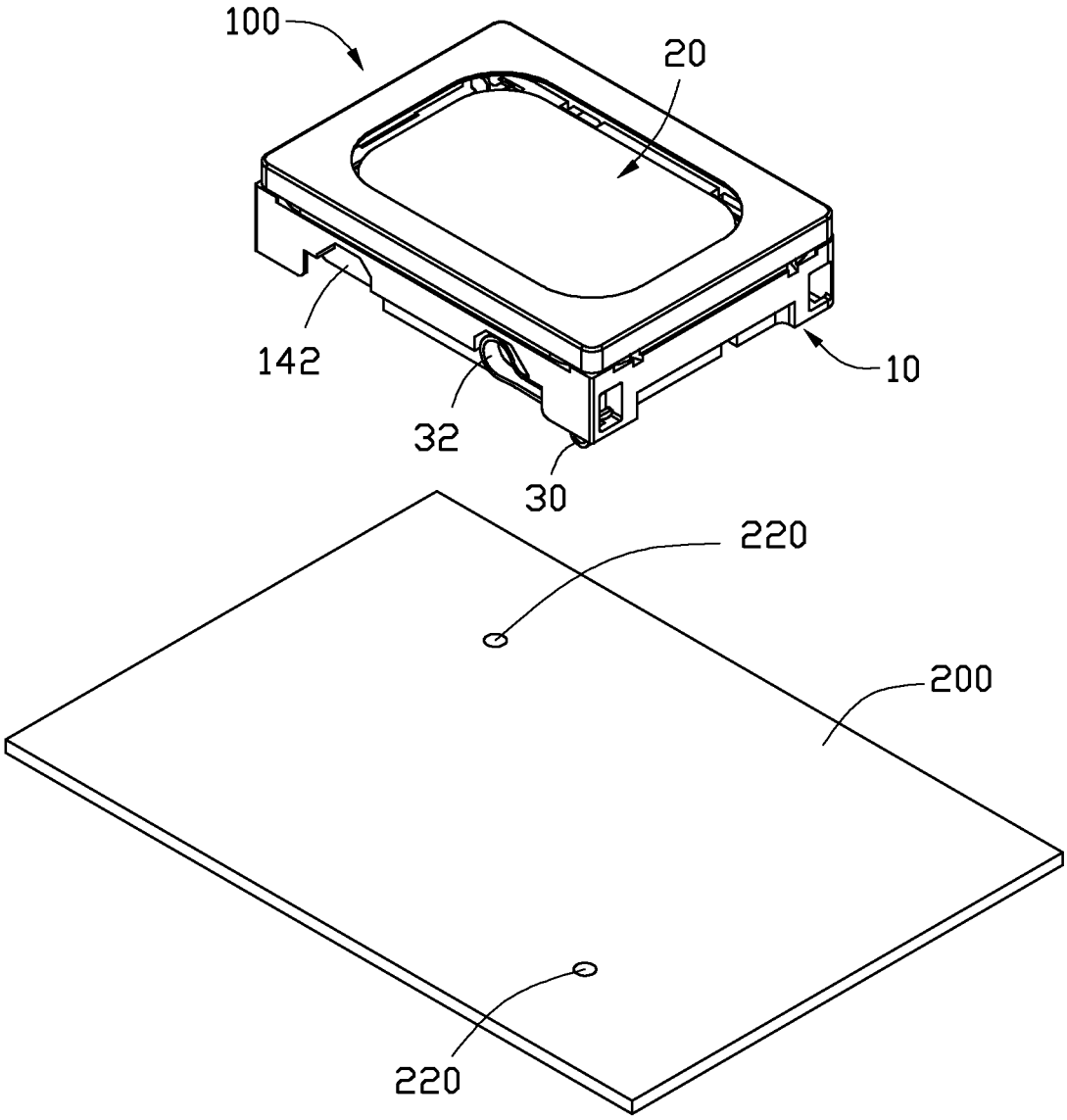
FIG. 4 illustrates the speaker of FIG. 1 assembled to a PCB.
Figure 5:
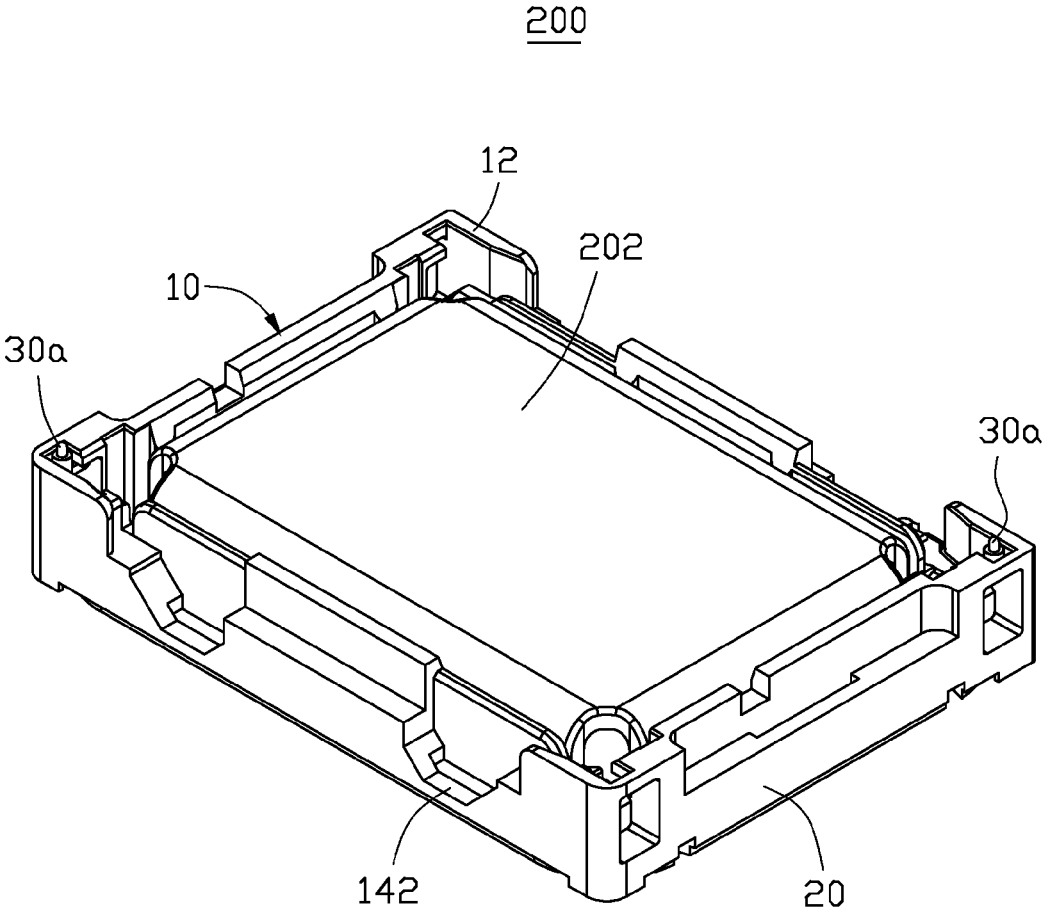
FIG. 5 illustrates a bottom side view of at speaker of FIG. 1.

FIG. 2 shows the speaker module 100 including a bracket 10, a speaker 20 held by the bracket 10, and a pair of pins 30 for assembling the speaker module 100 to a PCB 200 (shown in FIG. 4) and electrically connecting the speaker 20 with the PCB 200.

The speaker module 100 is cubic in shape. The bracket 10 includes a top surface 11 and a peripheral wall 12 surrounding the top surface 11. The peripheral wall 12 includes two oppositely positioned sidewalls, and defines two receiving grooves 142 towards the ends of each sidewall. That is, the bracket 10 has four receiving grooves 142 arranged approximately on four corners of the peripheral wall 12. Each receiving groove 142 is recessed towards the top surface 11 of the bracket 10.

The speaker 20 is received in and held by the bracket 10, and includes a diaphragm 201 exposed through an opening defined in the top surface 11, and a bottom surface 202 positioned opposite to the diaphragm 201. The bottom surface 202 faces the PCB 200 when the speaker module 100 is assembled to the PCB 200. The peripheral wall 12 protrudes a predetermined height from the bottom surface 202.

Figure 3:
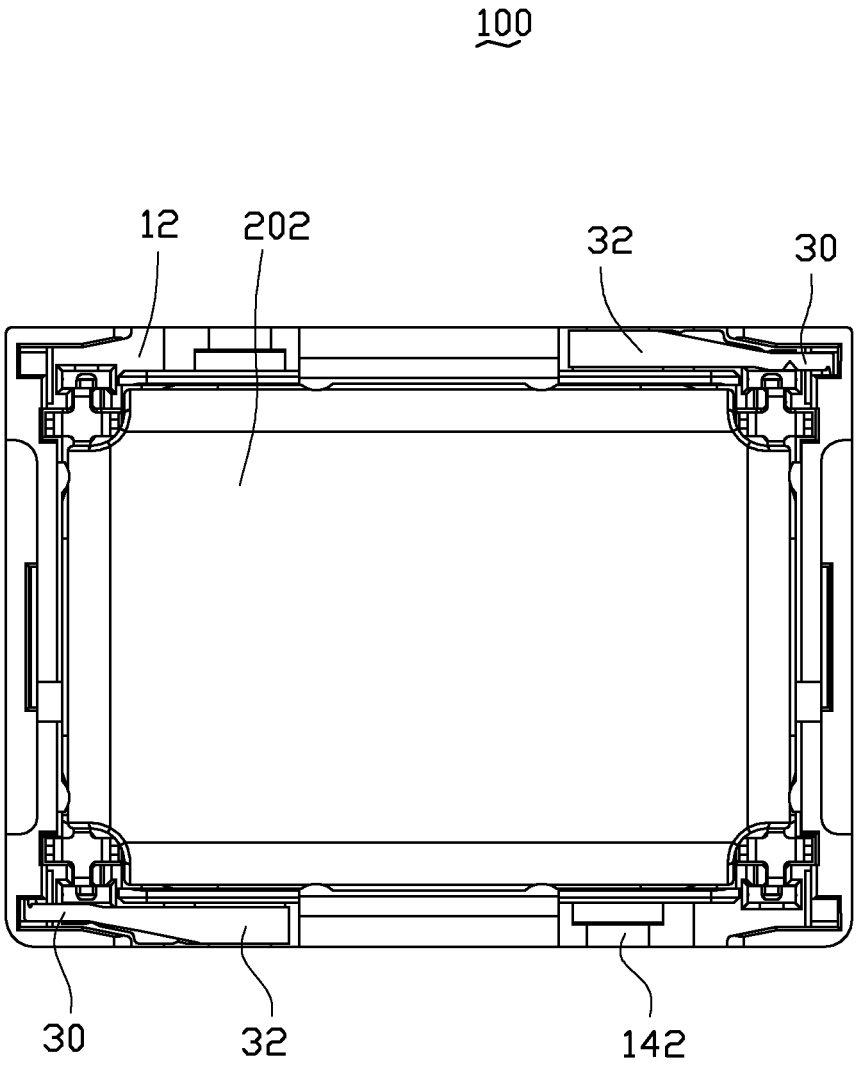
FIG. 3 illustrates a top side view of the speaker of FIG. 1.

FIG. 3 shows the pins 30 arranged diagonally on the bracket 10 and configured for being soldered to pads 220 of the PCB 200 to electrically connecting the speaker 20 with the PCB 200. During manufacturing, the pins 30 are easily attached to the pads 220 of the PCB 200 since the distance between the two pins 30 is substantial. The size of the speaker module 100 is still compact since only the manner of arrangement of the pins 30 is changed.

In addition, when the pins 30 are assembled to the speaker module 100, the speaker module 100 can be installed with a rotatable tool (not labeled), the two pins 30 can be assembled in one orientation, or the tool rotated through 180 degrees and the two pins 30 assembled in a reverse orientation.

Each pin 30 is a protruding portion of a conductive bent elastic metal element 32. One end of the metal element 32 is received in the receiving groove 142, while the other end extends towards the corner of the peripheral wall. The end portion of each metal element 32 near the corner of the peripheral wall 12 is bent and projects a predetermined height from the peripheral wall 12, and thus forming the pin 30. The pins 30 support the speaker module 100 at a predetermined height above the PCB 200, which facilitates the dissipation of heat generated by the speaker module 100.

The pins 30 can also be pads arranged on two diagonally-opposite corners of the peripheral wall 12. Due to the peripheral wall 12 projecting from the bottom surface 202, when the speaker module 100 is assembled on the PCB 200, the peripheral wall 12 supports the bottom surface 202 at a certain height above the PCB 200, which facilitates heat dissipation from the speaker module 100.

The pins 30 can also be needle shaped pins projecting from the corners of the peripheral wall 12. The pins 30 are inserted through the pads 220 of the PCB 200 and are soldered on the PCB 200, which can firmly assemble the speaker modules 100 more firmly on the PCB 200.

The speaker module 100 can also be oval in shape. The pins 30 are arranged diagonally on the peripheral wall 12 across the oval.

The speaker module 100 includes two pins 30 on diagonal corners, thus the distance between the pins 30 is enlarged to facilitate assembly of the speaker module 100 to the PCB 200, while the size of the speaker module 100 remains compact. Therefore, the speaker module 100 has advantages in convenience for assembly, less mistakes when assembly, and good reliability after being assembled.

Even though numerous characteristics and advantages of the embodiments have been set forth in the foregoing description, together with details of the structure and function of the embodiments, the present disclosure is illustrative only, and changes may be made in detail, especially in the matters of shape, size, and arrangement of parts within the principles of the embodiments to the full extent indicated by the broad general meaning of the terms in which the appended claims are expressed.

What is claimed is:

1. A speaker module, comprising:

a speaker;

a bracket holding the speaker, the bracket defining four receiving grooves on four corners;

only one pair of conductive pins for electrically connecting the speaker with a PCB being arranged diagonally in two diagonal receiving grooves on two diagonal corners of the bracket, wherein there is no other conductive pin for electrically connecting the speaker with the PCB arranged on the bracket.

2. The speaker module of claim 1, wherein the bracket includes a top surface and a peripheral wall surrounding the top surface.

3. The speaker module of claim 2, wherein the speaker is received in and is held by the bracket and includes a diaphragm exposed through an opening defined in the top surface, and a bottom surface positioned opposite to the diaphragm, the bottom surface is towards the PCB when the speaker module is assembled to the PCB.

4. The speaker module of claim 3, wherein the peripheral wall protrudes a predetermined height from the bottom surface.

5. The speaker module of claim 2, wherein the peripheral wall includes two oppositely positioned sidewalls and defines the receiving grooves towards ends of each sidewall diagonally.

6. The speaker module of claim 5, wherein each pin is a protruding portion of a bent elastic metal element, one end of the metal element is received in the receiving groove, while the other end extends towards the corner of the peripheral wall.

7. The speaker module of claim 6, wherein the end portion of the metal element near the corner of the peripheral wall is bent and projects a predetermined height from the peripheral wall.

8. The speaker module of claim 2, wherein the pins are pad-shaped and arranged on two diagonally-opposite corners of the peripheral wall.

9. The speaker module of claim 2, wherein the pins are needle shaped pins projecting from the corners of the peripheral wall and are inserted through pads of the PCB.

10. The speaker module of claim 1, wherein the speaker module is rectangular or oval in shape.

11. An electronic device, comprising:

a PCB, including at least a pair of pads;

a speaker module including a speaker;

a bracket holding the speaker, the bracket defining four receiving grooves on four corners;

only one pair of conductive pins for electrically connecting the speaker with the pads of the PCB being arranged diagonally in two diagonal receiving grooves on two diagonal corners of the bracket, wherein there is no other conductive pin for electrically connecting the speaker with the PCB arranged on the bracket.

12. The electronic device of claim 11, wherein the bracket includes a top surface and a peripheral wall surrounding the top surface.

13. The electronic device of claim 11, wherein the speaker is received in and is held by the bracket and includes a diaphragm exposed through an opening defined in the top surface, and a bottom surface positioned opposite to the diaphragm, the bottom surface is towards the PCB when the speaker module is assembled to the PCB.

14. The electronic device of claim 13, wherein the peripheral wall protrudes a predetermined height from the bottom surface.

15. The electronic device of claim 12, wherein the peripheral wall includes two oppositely positioned sidewalls and defines the receiving grooves towards ends of each sidewall diagonally.

16. The electronic device of claim 15, wherein each pin is a protruding portion of a bent elastic metal element, one end of the metal element is received in the receiving groove, while the other end extends towards the corner of the peripheral wall.

17. The electronic device of claim 16, wherein the end portion of the metal element near the corner of the peripheral wall is bent and projects a predetermined height from the peripheral wall.

18. The electronic device of claim 12, wherein the pins are pad-shaped and arranged on two diagonally-opposite corners of the peripheral wall.

19. The electronic device of claim 12, wherein the pins are needle shaped pins projecting from the corners of the peripheral wall and are inserted through pads of the PCB.

20. The electronic device of claim 11, wherein the speaker module is rectangular or oval in shape.

* * * * *